US007377039B2

(12) United States Patent
Al-Anizi et al.

(10) Patent No.: US 7,377,039 B2
(45) Date of Patent: May 27, 2008

(54) ANTI-CORROSION PROTECTION FOR HEAT EXCHANGER TUBE SHEET AND METHOD OF MANUFACTURE

(75) Inventors: Salamah S. Al-Anizi, Al-Danah Dhahran (SA); Abdulmalik A. Alghamdi, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 10/449,267

(22) Filed: May 29, 2003

(65) Prior Publication Data

US 2004/0238161 A1 Dec. 2, 2004

(51) Int. Cl.
*B21D 39/06* (2006.01)
*F28F 19/02* (2006.01)

(52) U.S. Cl. ..... 29/890.043; 165/76; 165/134.1; 165/158; 165/178

(58) Field of Classification Search ..... 165/134.1, 165/153, 173, 76; 29/890.043
See application file for complete search history.

(56) References Cited

U.S. PATENT DOCUMENTS

| | | | | |
|---|---|---|---|---|
| 1,235,835 | A | 8/1917 | Nilson | |
| 1,646,384 | A | 10/1927 | Bergstrom | |
| 1,894,956 | A * | 1/1933 | Kerr | 165/134.1 |
| 2,660,411 | A * | 11/1953 | Weber | 165/134.1 |
| 2,779,279 | A | 1/1957 | Maiwurm | |
| 2,868,513 | A * | 1/1959 | Orr et al. | 165/134.1 |
| 3,114,415 | A * | 12/1963 | Wintzer | 165/134.1 |
| 3,195,624 | A * | 7/1965 | Richards et al. | 165/134.1 |
| 3,428,338 | A | 2/1969 | Corwin | |
| 3,440,391 | A * | 4/1969 | Apblett | 165/134.1 |
| 4,142,581 | A * | 3/1979 | Yoshitomi et al. | 165/173 |
| 4,154,464 | A | 5/1979 | Stary | |
| 4,182,408 | A * | 1/1980 | Laber | 165/134.1 |
| 4,252,182 | A * | 2/1981 | Fender | 165/134.1 |
| 4,495,987 | A * | 1/1985 | Finnan | 165/173 |
| 4,579,171 | A * | 4/1986 | Stafford et al. | 165/173 |
| 5,575,330 | A | 11/1996 | Hoeffken | |
| 6,138,747 | A | 10/2000 | Kroger et al. | |
| 6,206,086 | B1 | 3/2001 | McKey | |
| 6,278,636 | B1 | 8/2001 | Lee | |
| 2001/0040024 | A1 * | 11/2001 | Blanda, Jr. et al. | 165/134.1 |

* cited by examiner

*Primary Examiner*—Leonard R Leo
(74) *Attorney, Agent, or Firm*—Abelman, Frayne & Schwab

(57) ABSTRACT

A corrosion-resistant alloy metal tube sheet used to construct a shell and tube heat exchanger (50) for cooling fluids with sea water passing through corrosion-resistant alloy tubes (25) contained in a horizontal carbon steel outer shell (1) that are supported and sealed at each end by passing them through holes (27, 30) in a carbon steel tube sheet (28, 31) and axially aligned holes (36, 37) in alloy tube sheets (34, 35) that cover and protect the adjacent interior carbon steel tube sheets from sea water corrosion. The walls of the holes (27, 30, 36, 37) have at least one annular groove (45, 46) and the ends of each tube are radially expanded to form circumferential ridges (40, 41) on the outside of each tube at a mating location with each of said annular grooves (45, 46) where they are forcibly driven into the grooves to form a circumferential joint having good mechanical strength and water tightness, thereby eliminating the need for welding the external joint between the alloy tube sheets and alloy tubes.

16 Claims, 3 Drawing Sheets

ANTI-CORROSION PROTECTION FOR HEAT EXCHANGER TUBE SHEET AND METHOD OF MANUFACTURE

FIELD OF THE INVENTION

This invention relates to an improvement in the construction of shell and tube heat exchangers where sea water is the coolant for non-contact heat exchange with a gaseous or liquid fluid.

BACKGROUND OF THE INVENTION

Sea water heat exchangers are commonly utilized in the oil and gas processing industry and in refineries where fresh water supplies may be limited. Design details of shell and tube type heat exchangers are described in Perry's Chemical Engineers' Handbook; 7th ed., McGraw-Hill. Reference is also made to the publications of the Tubular Exchanger Manufacturers Association (TEMA).

In chemical plant and refinery locations where sea water is plentiful and cheap, it is economically desirable to use sea water as the cooling medium in coolers for gases and liquids. However, because of its corrosivity, sea water has been used only as a coolant in coolers made from expensive corrosion-resistant alloys.

The alloy tube sheet protective cover duplicates the configuration and number and placement of the tube receiving holes in the carbon steel tube sheet. The alloy and carbon steel tube sheets are mechanically sealed at their periphery by means described below.

It is common practice to weld the extended end portion of the tube to the outside of the alloy tube sheet for sealing purposes. Welding is a time-consuming and costly manufacturing process for tube sheets with hundreds of tubes. Highly skilled and motivated welders are required to produce a quality product. Low quality welded joints can result in sea water leaks and the hidden corrosion of the carbon steel base plate. This problem is increased with passage of time when corrosive sea water coolant at high temperature is in contact with the carbon steel. Further, it is an expensive and time-consuming process to remove a tube with a welded end sealing joint from the alloy tube sheet. By eliminating welding, manufacturing and maintenance costs of such coolers would be reduced.

It is also known in the construction of shell and tube heat exchangers to insert the tubes into the holes in the tube carbon steel sheet and radially expand each of the tubes to secure it in place in a groove formed in the interior surface of the hole. There must be good mechanical bond strength and water tightness in the resulting joint between the tube sheet and each tube.

A method and apparatus for expanding a tube into a groove in the wall of a hole in a tube sheet is described in U.S. Pat. No. 4,142,581. However, this disclosure is not directed to the use of a sea water coolant and no sea water-resistant alloy tube sheet covering is present to protect the carbon steel tube sheet. There is also no corrosion-resistant alloy metal joint between the tubes and the tube sheet for sealing purposes and for corrosion protection of a carbon steel tube sheet.

The subject invention, produces a mechanically strong joint having chemical corrosion resistance to sea water. This joint permits the use of comparatively low cost method for protecting the carbon steel parts for the cooler, e.g., the shell and tube sheets.

Existing welding practices can now be replaced by the subject invention. In such case, there will be a savings in weld material, working time and speed up in the heat exchanger repair cycle. Also, the removal of tubes from the tube sheet will be easier in the absence of a welded seal.

BRIEF DESCRIPTION OF THE DRAWINGS

The present invention and the manner for practicing its preferred embodiments will be further illustrated by the accompanying drawings wherein.

DETAILED DESCRIPTION OF THE PREFERRED EMBODIMENTS

Figure 1:
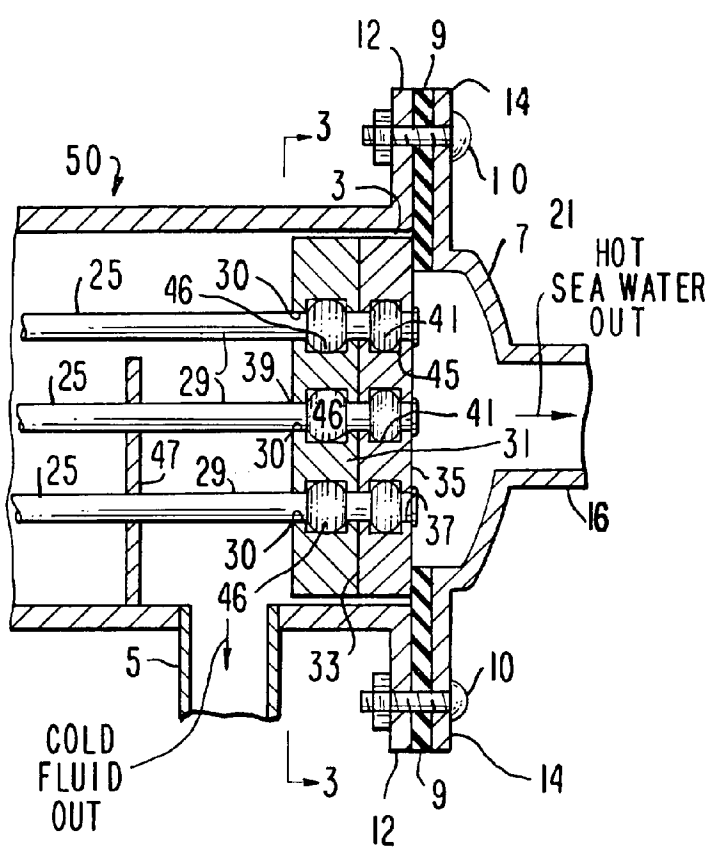
FIG. 1 is a vertical cross-sectional view taken along the central axis of the cylindrical heat exchanger constructed in accordance with the present invention.

Referring now to FIG. 1, the shell and tube cooler 50 embodying the present invention comprises an elongated cylindrical closed shell having upstream end 2 and downstream end 3, hot fluid inlet 4 and cooled fluid outlet 5. Shell 1 is closed by flanged domed covers 6 and 7. Ring gaskets 8 and 9, that provide seals against leakage of the coolant, are placed respectively between left and right shell flanges 11 and 12 and left and right head cover flanges 13 and 14. Any suitable gasket material may be used, e.g., Teflon, asbestos, synthetic rubber or fiberglass. Flanges 13, 11 and 14, 12, respectively, are bolted with nuts and bolts 10. Left and right domed covers can be expendable and made from carbon steel or alternatively from salt water-resistant alloy metal. Other conventional means (not shown) can be used to close the cooler, e.g., clamps, welding, etc. Cover 6 is provided with inlet pipe 15 for the introduction of cold sea water. Cover 7 is provided with outlet pipe 16 for the removal of the sea water after exchange in shell 1. In the embodiment illustrated, inlet pipe 15 and outlet pipe 16 are positioned so that their central horizontal axes coincide with the central horizontal axis of shell 1, but other configurations known to the art can be utilized in practicing the inventions.

Tube bundle 24 comprises a plurality of spaced horizontal tubes 25. The left end 26 of each tube 25 in the tube bundle is passed through a separate corresponding hole 27 in carbon steel tube sheet 28. All of the holes in the left (upstream) and right (downstream) carbon steel tube sheets 28 and 31 have the same reference numbers, respectively, i.e., 27 for each of the holes in the left carbon steel tube sheet 28 and 30 for each of the holes in the right carbon steel tube sheet 31. Similarly, each right end 29 of each tube 25 passes through a separate hole 30 in right round carbon steel tube sheet 31. All of the holes in the left (upstream) and right (downstream) salt water-resistant alloy tube sheets 34 and 35 have the same reference numbers, respectively, i.e. 36 for each of the holes in the left alloy tube sheet and 37 for each of the holes in the right alloy tube sheet. The exterior faces 32 and 33 of carbon steel tube sheets 28 and 31 are covered or clad with a sea water-resistant alloy tube sheets 34 and 35. All of the holes in the alloy tube sheets 34 and 35 have the same reference numbers, respectively, i.e. 36 for each of the holes in the left alloy tube sheet 34 and 37 for each of the holes in the right alloy tube sheet 35. The central axis of each hole in each tube sheet is transverse to both faces of the tube sheets. All left and right tube ends 26 and 29 in tube bundle 24, respectively, pass through holes 36 and 37 in alloy tube sheets 34 and 35.

Corrosion-resistant alloy tubes 25 and alloy tube sheets 34 and 35 are made from a metal alloy selected from the group that includes Monel, Inconel, and stainless steel.

The opposing ends 26 and 29 of all tubes 25 in tube bundle 24 are provided with water tight joints where the tubes pass through each tube sheet. This is accomplished by radially expanding at least one circumferential ridges 40 and 41, respectively, in the left and right ends of each tube. As the circumferential ridges are formed, they are simultaneously swaged and forcibly driven into mating circumferential annular grooves 45 in the surrounding walls of all of the holes 36 and 37 in left and right alloy tube sheets. In the preferred embodiment illustrated and described, the grooves have a rectangular cross-section. Circumferential ridges are also forcibly driven into all of the mating circumferential rectangular annular grooves in the surrounding walls of all of the holes 27 and 30 in carbon-steel tube sheets 28 and 31.

When head cover flange 13 is bolted to shell flange 11, the end portion 20 of head cover flange 13 compresses gasket 8 and a ring portion of the face of left alloy tube sheet 34. Similarly, when right head cover flange 14 is bolted to right shell flange 12 the end portion 21 of right head cover flange 14 compresses gasket 9 and a ring portion of the face of right alloy tube sheet 35. By this sealing means, coolant is prevented from entering into the shell side of the cooler. Corrosion-resistant alloy tube sheets 34 and 35 have a thickness in the range of about 1.0 to 1.5 cm. Carbon steel tube sheets 28 and 31 have a thickness in the range of about 2.54 to 25.4 cm. The outside diameter of tubes 25 can be the range of about 1.587 to 5.08 and have a wall thickness in the range of about 0.124 to 0.305 cm.

Figure 4:
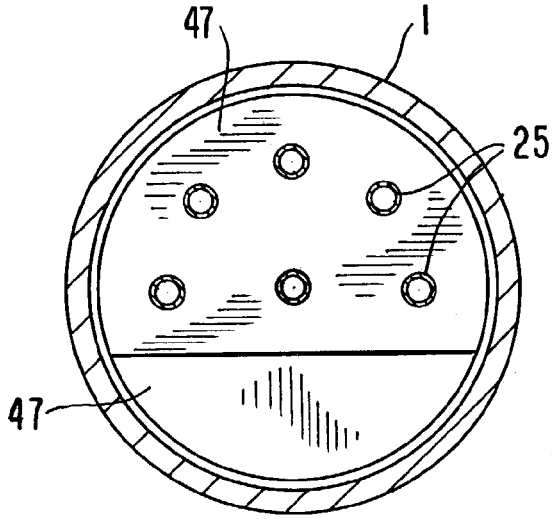
FIG. 4 is a cross-sectional view along line 4-4 of FIG. 1, showing a layout of tubes passing through a directional flow control tube sheet having a bottom passage for the free flow of FIG. 5 is a view similar to FIG. 2 showing another embodiment of the invention.

Fluid flow within shell 1 can optionally be controlled by a plurality of internal baffles 47 positioned transversely to the axis of shell 1, as best shown in FIG. 4.

With reference now to FIG. 4, one of a plurality of conventional fluid directional flow control baffles 47 is shown for controlling the path that the gaseous or liquid fluid to be cooled takes in shell 1 from inlet to outlet. These baffles are made from carbon steel sheet and have a sectional opening in the bottom or top through which the fluid passes. The holes in the baffle are in alignment with the holes in the tube sheets so that the tubes are horizontal in the tube bundle. The use of directional flow control baffles in the heat exchanger is optional.

Figure 2:
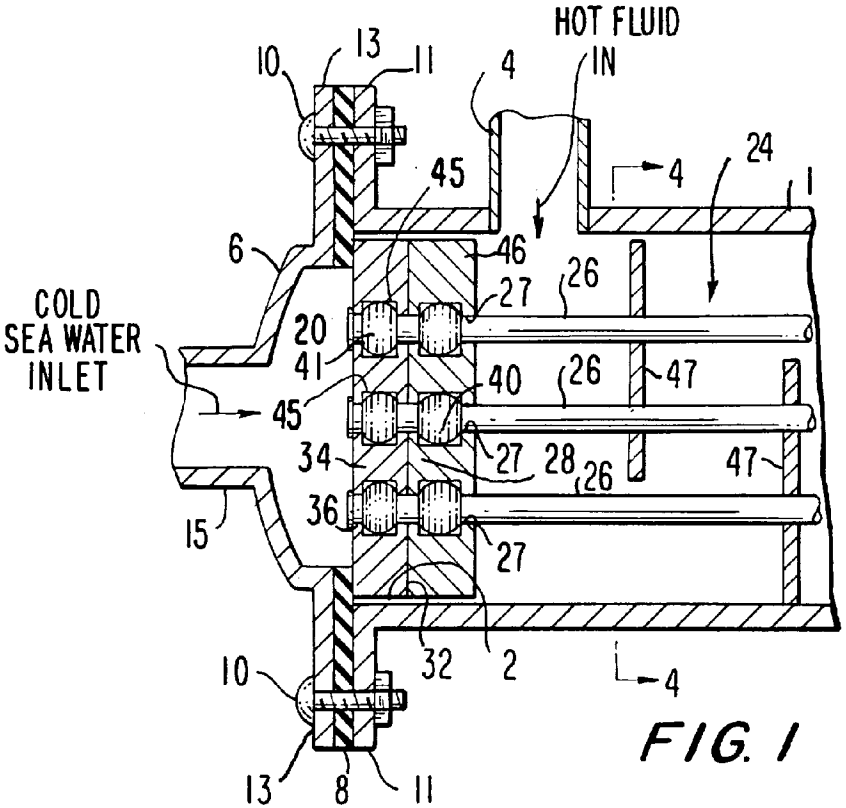
FIG. 2 is an enlarged detail view of the heat exchanger of FIG. 1 showing aligned holes in the tube sheets and the water tight joints between the tubing and the tube sheets.
Figure 2:
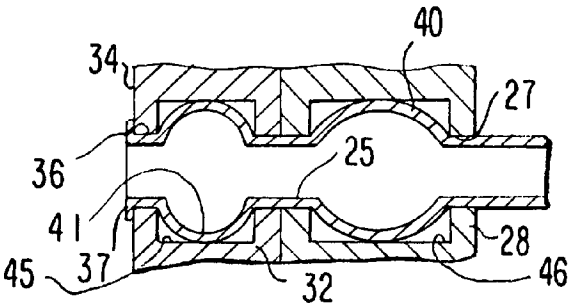

Referring now to FIG. 2, a portion of carbon steel tube sheet 28 is shown faced on its exterior surface with corrosion-resistant alloy tube sheet 34. Also shown is the water tight joint made by simultaneously forming a circumferential ridge 41 on the surface of alloy tubing 25 and forcibly driving it into mating rectangular groove 45 in the surrounding wall of each hole 36 in alloy tube sheet 34. For illustrative purposes, one rectangular shaped annular groove 46 and one rectangular shaped annular groove 45 are machined into the surrounding walls respectively of holes 27 in tube sheet 28 and in the walls of coaxially aligned holes 36 in alloy tube sheet 34. However, there may be from 1 to 3 grooves, e.g., two parallel spaced annular grooves in the surrounding walls of each opening in the carbon steel tube sheets as well as in the surrounding walls of each aligned hole in the alloy metal tube sheets. In one embodiment, one annular groove is provided in the surrounding wall of each hole in tube sheets 34 and 35, and two parallel spaced annular grooves in the surrounding walls of each of the holes in tube sheets 28 and 31.

A tube expander of conventional design is inserted into each end of each tube in the tube bundle and expanded radially to form the circumferential ridges. For example, a conventional tube expander as shown and described in U.S. Pat. No. 4,142,581,can be used to make from one to three parallel circumferential ridges 40 and 41 on the outside surface of the tubes. Each circumferential ridge is transverse to the central axis of the tube on which it is formed. These circumferential ridges 40 and 41 are located at the end of each tube to mate with the annular grooves 46 and 45 in the walls of holes 27 and 36 in the tube sheets. As each ridge is formed, it is simultaneously forcibly pressed or driven radially into its corresponding mating annular groove 46 and 45 to provide a mechanically strong water tight joint.

The depth of the annular grooves 45 and 46 is in the range of about 0.25 to 1.0 mm, and the width is in the range of about 3 to 5 mm.

Optionally, the ends of tubes 25 can be flared outwardly and against the adjacent surface of the alloy tube sheet to improve its resistance to lateral movement.

Figure 3:
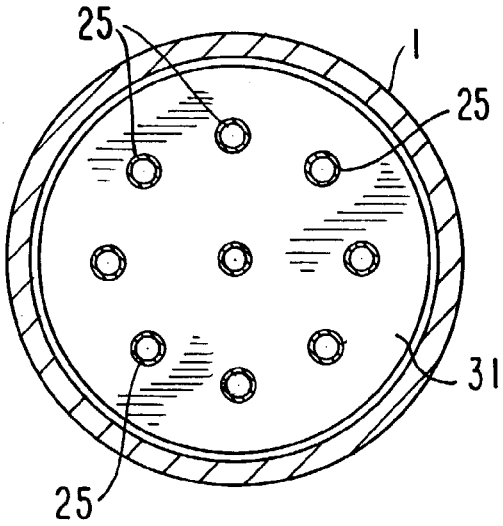
FIG. 3 is a cross-sectional view along line 3-3 of FIG. 1, showing the symmetrical layout of the tubes passing through the right carbon steel tube sheet.

Referring now to FIG. 3, the symmetrical arrangement of tubes 25 passing through the close fitting opening in round carbon steel tube sheet 31 is shown in Section 3-3 of FIG. 1. Clearance is shown between the close-fitting outside diameter of tube sheet 31 and the inside diameter of cylindrically shaped outer shell 1 to permit the tubes to be slidably introduced into outer shell 1 or removed therefrom for or repair or replacement.

Figure 5:
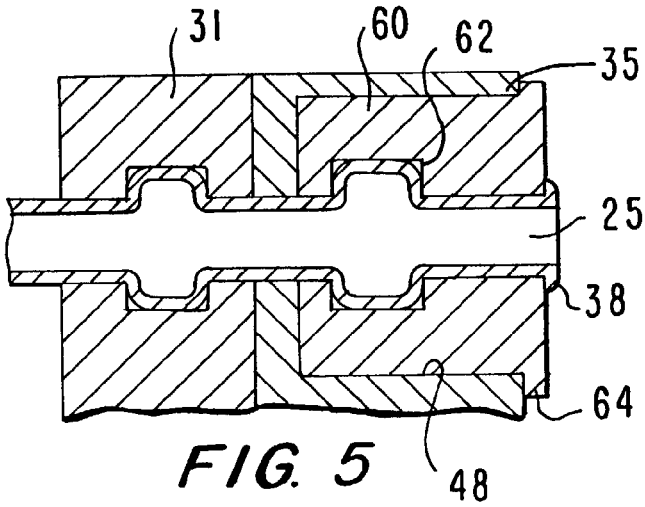
Figure 6:
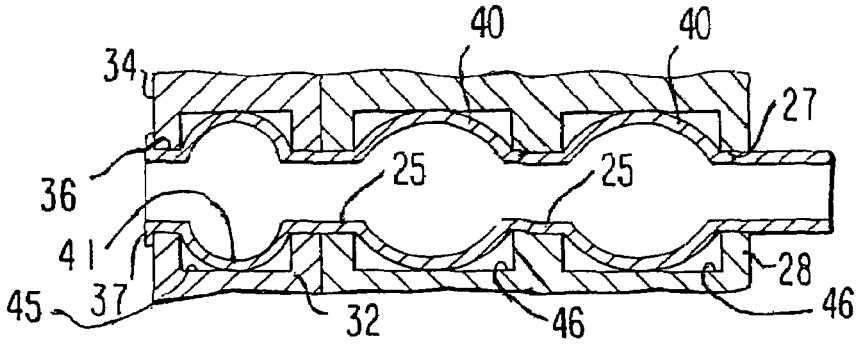
FIG. 6 is a view similar to FIG. 2 showing yet another embodiment of the invention.

Referring to FIG. 5, in a further preferred embodiment, the alloy tube sheet 35 can be provided with an opening 48 larger than the diameter of the alloy tube 25 and fitted with a liner or ring 60 that includes an interior radial groove 62. This construction can be used where the alloy tube sheet 35 is relatively softer or more ductile than the alloy tube that is to be swaged into the tube sheet groove. The grooved lining ring 60 can be inserted by a press fitting alone or in combination with heating of the parts. The grooved lining ring can have a flange 64 on one or both sides to engage the surface of the alloy tube sheet to facilitate insertion of the alloy tubes and avoid having the lining ring dislodged by impact of an end of a tube during insertion.

As will be understood by one of ordinary skill in the art, the method of assembly and the finished construction of the invention will greatly facilitate the removal and replacement of the alloy tubes as compared to the prior art constrictions where the ends of the tubes were welded to the tube sheet. The flared end of a damaged or leaking tube can be removed by grading, an impact tool or other specialized cutting tool. The portion of the alloy tube forced into the grooves in the tube sheets can be cut away by the same type of tool used to cut the original grooves. The tube can then be withdrawn from the tube sheet.

Other modifications and variations of the invention as set forth above may be made without departing from the spirit and scope thereof, and therefore, only such limitations should be imposed in the invention as are indicated in the appended claims.

We claim:

1. In the construction of a shell and tube heat exchanger for cooling fluids by non-contact heat exchange with sea water comprising an outer horizontal cylindrically shaped shell and an enclosed bundle of horizontally disposed corrosion-resistant alloy tubes with each end of each tube passing through an opening in a supporting carbon steel tube sheet, said shell and tube heat exchanger comprising a closed outer shell with an inlet for introducing said fluid into the shell and an outlet for removing said fluid, a removable tube bundle comprising a plurality of corrosion-resistant alloy tubes spaced apart from each other and contained in said shell, a first cover with an inlet for introducing sea water into the tubes, and a second opposing cover with an outlet for removing sea water from said tube heat exchanger, the opposing ends of said tubes extending, respectively, through first openings formed in a wall of a carbon steel tube sheet clad with a single solid corrosion-resistant alloy tube sheet that is in contact with the sea water, the ends of the tubes expanded into at least one annular groove formed in the walls of the first openings of the carbon steel tube sheets, said corrosion-resistant alloy tube sheet including a second opening associated with each alloy tube extending therethrough, and each second opening being lined with a liner having an interior radial groove for securing a circumferential ridge of the alloy tube, wherein the second opening in the alloy tube sheet is in the form of a recess that extends from the exterior surface and partially through the alloy tube sheet to thereby provide a water-tight mechanical seal between the corresponding tube ends and each of the alloy tube sheets, a method for protecting said carbon steel tube sheets from corrosion by contact with the sea water, the method comprising, (a) covering the exterior face of said carbon steel tube sheet with the corrosion-resistant alloy tube sheet containing a plurality of openings corresponding to the openings in said carbon steel tube sheet, the surrounding wall of each said opening in each tube sheet being provided with at least one annular groove;

(b) passing a corrosion-resistant alloy tube through a pair of aligned openings in (a);

(c) inserting a tube expander into the end of said tube and radially expanding said tube radially at locations corresponding to said annular grooves in (a) to form a circumferential ridge; and (d) simultaneously forcibly driving the circumferential ridge formed in (c) into a corresponding annular groove to form a watertight joint, whereby the watertight joint in the alloy tube sheet prevents the sea water from coming into contact with the carbon steel tube sheet.

2. The method of claim 1, wherein the openings in said tube sheets are circular and said annular grooves are rectilinear in cross-section.

3. The method of claim 2, wherein said annular groove has a width in the range of about 3.175 to 4.76 mm, and a depth in the range of about 0.397 to 0.794 mm.

4. The method of claim 1, wherein said corrosion resistant alloy is selected from the group consisting of copper and nickel-based alloys and stainless steel.

5. The method of claim 1, wherein the corrosion resistant alloy has a thickness in the range from 0.635 cm to 0.953 cm.

6. The method of claim 1, wherein the at least one groove in the alloy tube sheet is formed by a cutting tool.

7. The method of claim 6, wherein the groove is cut when the opening is formed in the alloy tube sheet.

8. The method of claim 1, wherein two circumferential annular grooves are formed in the surrounding wall of each opening in said carbon steel tube sheet and one circumferential annular groove is formed in the surrounding wall of each opening in said corrosion-resistant alloy tube sheet.

9. The method of claim 1, wherein the end of the alloy tube is flared outwardly to contact the surface of the alloy tube sheet.

10. In a cooler for cooling fluids by non-contact heat exchange with sea water coolant, a method for protecting the exterior surface of a carbon steel tube sheet and the circumferential joints between a plurality of alloy tubes passing through transverse openings in said carbon steel tube sheets from contact with the coolant, wherein the interior surface of said carbon steel tube sheet does not contact the coolant, said cooler comprising a shell and tube heat exchanger including a closed outer shell with an inlet for introducing said fluid into the shell and an outlet for removing said fluid, a removable tube bundle comprising a plurality of corrosion-resistant alloy tubes spaced apart from each other and contained in said shell, a first cover with an inlet for introducing sea water into the tubes, and a second opposing cover with an outlet for removing sea water from said tube heat exchanger, the opposing ends of said tubes extending, respectively, through first openings formed in a wall of said carbon steel tube sheet clad with a single solid corrosion-resistant alloy tube sheet that is in contact with the sea water, the ends of the tubes expanded into at least one annular groove formed in the walls of the first openings of the carbon steel tube sheets, said corrosion-resistant alloy tube sheet including a second opening associated with each alloy tube extending therethrough, and each second opening being lined with a liner having an interior radial groove for securing a circumferential ridge of the alloy tube, wherein the second opening in the alloy tube sheet is in the form of a recess that extends from the exterior surface and partially through the alloy tube sheet to thereby provide a water-tight mechanical seal between the corresponding tube ends and each of the alloy tube sheets, the method comprising the steps of:

(a) covering the sea water exposed exterior face of the carbon steel tube sheet with the corrosion-resistant alloy tube sheet containing a plurality of aligned openings corresponding to said openings in said carbon steel tube sheet, the surrounding walls of each coaxial opening in the carbon steel and alloy tube sheets being provided with at least one radially extending groove;

(b) positioning the ends of said alloy tubes on the aligned openings in the tube sheets;

(c) inserting a tube expander into the end of each tube and radially expanding the wall of each tube at locations corresponding said annular grooves in said tube sheets to form a circumferential ridge; and (d) simultaneously forcibly driving each circumferential ridge as it is formed into a corresponding annular groove to form at least one water tight mechanical seal between said tube and the adjacent carbon steel and alloy tube sheets.

11. A shell and tube cooler for cooling a fluid by non-contact heat exchange with sea water comprising:

a closed outer shell with an inlet for introducing said fluid into the shell and an outlet for removing said fluid, a removable tube bundle comprising a plurality of corrosion-resistant alloy tubes spaced apart from each other and contained in said shell, a first cover with an inlet for introducing sea water into the tubes, and a second opposing cover with an outlet for removing sea water from said cooler, the opposing ends of said tubes extending, respectively, through first openings formed in a wall of a carbon steel tube sheet clad with a single solid corrosion-resistant alloy tube sheet cover that is in contact with the sea water, the ends of the tubes expanded into at least one annular groove formed in the walls of the first openings of the carbon steel tube sheets, said corrosion-resistant alloy tube sheet including a second opening associated with each alloy tube extending therethrough, and each second opening being lined with a liner having an interior radial groove for securing a circumferential ridge of the alloy tube, wherein the second opening in the alloy tube sheet is in the form of a recess that extends from the exterior surface and partially through the alloy tube sheet to thereby provide a water-tight mechanical seal between the corresponding tube ends and each of the alloy tube sheet covers.

12. The cooler of claim 11, wherein the ends of the tubes are flared into contact with the liner of the supporting corrosion-resistant alloy tube sheet.

13. The cooler of claim 11, wherein each of the first openings in the carbon steel tube sheets has two parallel annular grooves for receiving corresponding radially extending ridges formed in the tubes passing through the openings.

14. The cooler of claim 11, wherein the alloy tube sheet is relatively more ductile than the liners fitted into the sheet.

15. The cooler of claim 11, wherein the liners are formed with a flange that engages the exterior surface of the alloy tube sheet.

16. The cooler of claim 11, wherein the liner is press fitted into the opening in the alloy tube sheet.

* * * * *